US006296557B1

(12) United States Patent
Walker

(10) Patent No.: US 6,296,557 B1
(45) Date of Patent: Oct. 2, 2001

(54) METHOD AND APPARATUS FOR RELEASABLY ATTACHING POLISHING PADS TO PLANARIZING MACHINES IN MECHANICAL AND/OR CHEMICAL-MECHANICAL PLANARIZATION OF MICROELECTRONIC-DEVICE SUBSTRATE ASSEMBLIES

(75) Inventor: Michael A. Walker, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/285,319

(22) Filed: Apr. 2, 1999

(51) Int. Cl.[7] ..... B24D 11/00

(52) U.S. Cl. ..... 451/526; 451/539; 451/490

(58) Field of Search ..... 451/41, 523, 539, 451/287, 288, 289, 550, 527, 538, 63, 296, 302, 307, 490, 502, 512, 513, 526, 530

(56) References Cited

U.S. PATENT DOCUMENTS

| | | | | |
|---|---|---|---|---|
| 3,695,131 | | 10/1972 | Zimmermann | 83/56 |
| 3,918,220 | | 11/1975 | Jury et al. | 51/328 |
| 4,617,767 | * | 10/1986 | Ali | 451/538 |
| 5,201,785 | * | 4/1993 | Nagano | 451/538 |
| 5,876,268 | * | 3/1999 | Lamphere et al. | 451/41 |
| 5,958,794 | * | 9/1999 | Bruxvoort et al. | 451/539 |
| 6,036,586 | * | 3/2000 | Ward | 451/538 |
| 6,099,603 | * | 8/2000 | Johnson | 451/538 |

FOREIGN PATENT DOCUMENTS 0 774 323 A2 5/1997 (EP) .

* cited by examiner

*Primary Examiner*—Derris H. Banks
(74) *Attorney, Agent, or Firm*—Dorsey & Whitney LLP

(57) ABSTRACT

A method and an apparatus for releasably attaching a polishing pad to a support surface under the polishing pad. In one embodiment of the invention, a polishing pad has a first surface for planarizing a substrate assembly, a second surface contacting the support surface, and an interlocking element. The support surface has a retaining member configured to engage the interlocking element on the polishing pad. The interlocking element and retaining member can be any one of several configurations, including: tongue and groove, protuberance and depression, reciprocal elongated ridges, or teeth.

12 Claims, 12 Drawing Sheets

METHOD AND APPARATUS FOR RELEASABLY ATTACHING POLISHING PADS TO PLANARIZING MACHINES IN MECHANICAL AND/OR CHEMICAL-MECHANICAL PLANARIZATION OF MICROELECTRONIC-DEVICE SUBSTRATE ASSEMBLIES

TECHNICAL FIELD

The present invention relates to methods and devices for releasably coupling a polishing pad to a support surface of a planarizing machine used in mechanical and/or chemical-mechanical planarization of microelectronic-device substrate assemblies.

BACKGROUND OF THE INVENTION

Mechanical and chemical-mechanical planarizing processes (collectively "CMP") are used in the manufacturing of electronic devices for forming a flat surface on semiconductor wafers, field emission displays and many other microelectronic-device substrate assemblies. CMP processes generally remove material from a substrate assembly to create a highly planar surface at a precise elevation in the layers of material on the substrate assembly.

FIG. 1 is a schematic isometric view of a web-format planarizing machine 100 that has a support table 102 with a support surface 110 at a workstation defining a planarizing zone. The support surface 110 is generally a rigid panel or plate attached to the table 102 to provide a flat, solid surface to which a portion of a web-format planarizing pad 140 is supported during planarization. The planarizing machine 100 also has a plurality of rollers to guide, position, and hold the web-format pad 140 over the support surface 110. The rollers generally include a supply roller 120, first and second idler rollers 121*a* and 121*b*, first and second guide rollers 122*a* and 122*b*, and a take-up roller 123. As explained below, a motor (not shown) drives the take-up roller 123, and possibly the supply roller 120, to advance the pad 140 across the support surface 110 along a travel axis T—T. The first idler roller 12 la and the first guide roller 122*a* also stretch the pad 140 over the support surface 110 to hold the pad 140 during operation.

The planarizing machine 100 also has a carrier assembly 130 to translate a substrate assembly 12 across the pad 140. In one embodiment, the carrier assembly 130 has a substrate assembly holder 132 to pick up, hold and release the substrate assembly 12 at appropriate stages of the planarizing process. The carrier assembly 130 also has a support gantry 134 and a drive assembly 135 that can move along the gantry 134. The drive assembly 135 has an actuator 136, a drive shaft 137 coupled to the actuator 136, and an arm 138 projecting from the drive shaft 137. The aim 138 carries the substrate assembly holder 132 via another shaft 139. The actuator 136 orbits the substrate assembly holder 132 about an axis B—B to move the substrate assembly 12 across the pad 140.

The polishing pad 140 may be a non-abrasive polymeric web (e.g., a polyurethane sheet), or it may be a fixed abrasive polishing pad having abrasive particles fixedly dispersed in a suspension medium. During planarization of the substrate assembly 12, a planarizing fluid 144 flows from a plurality of nozzles 145. The planarizing fluid 144 may be a conventional CMP slurry with abrasive particles and chemicals that etch and/or oxidize the substrate assembly 12, or the planarizing fluid 144 may be a nonabrasive planarizing( solution without abrasive particles. In most CMP applications, abrasive slurries are used on non-abrasive polishing pads, and non-abrasive planarizing solutions are used on fixed abrasive polishing pads.

The planarizing machine 100 incrementally moves the pad 140 across the support surface 110 either during or between planarizing cycles to change the particular portion of the polishing pad 140 in the planarizing zone. For example, the supply and take-up rollers 120 and 123 can drive the polishing pad 140 such that a point P moves incrementally across the support surface 110 to a number of intermediate locations $I_1$, $I_2$, etc. Alternatively, the rollers 120 and 123 may drive the polishing pad 140 such that the point P moves all the way across the support surface 110 to completely remove a used portion of the pad 140 from the planarizing zone on the support surface 110. The rollers may also continuously drive the polishing pad at a slow rate such that the point P moves continuously across the support surface 110. Thus, the polishing pad 140 should be free to move axially over the length of the support surface 110 along the travel axis T—T.

CMP processes should consistently and accurately produce a uniform, planar surface on the substrate assembly to enable circuit and device patterns to be formed with photolithography techniques. As the density of integrated circuits increases, it is often necessary to accurately focus the critical dimensions of the photo-patterns to within a tolerance of approximately 0.1 $\mu$m. Focusing photo-patterns to such small tolerances, however, is difficult when the planarized surface of the wafer is not uniformly planar. Thus, CMP processes should create a highly uniform, planar surface to be effective.

One processing concern associated with web-format planarizing machines is that the polishing pad 140 may move transversely to the travel axis T—T during a planarizing cycle of the substrate assembly 12. For example, although the first idler roller 121*a* and the first guide roller 122*a* stretch the pad 140 over the support surface 110, the orbital motion of the substrate assembly 12 and the friction between the substrate assembly 12 and the pad 140 may cause the pad 140 to move transverse to the travel axis T—T. Such transverse movement of the polishing pad 140 can produce inconsistent planarizing results because it stretches and/or damages the polishing pad 140. The transverse movement of the polishing pad 140 may also allow the slurry to seep underneath the polishing pad 140, which causes uneven wear of the pad 140 and contamination of the planarizing machine 200. Moreover, if the pad wears unevenly, the topography of the pad may cause vibrations in the CMP machine that further affect the planarity of the finished surface and the consistency of the CMP process.

SUMMARY OF THE INVENTION

The present invention is directed toward methods and apparatuses for releasably securing a polishing pad to a support surface in mechanical and/or chemical-mechanical planarization of microelectronic-device substrate assemblies. In one embodiment of the invention, a polishing pad for planarizing microelectronic-device substrate assemblies has a first surface configured to engage a substrate assembly and a second surface configured to releasably engage the support surface of a planarizing machine. The second surface of the polishing pad, for example, can have an interlocking element configured to engage a corresponding retaining member on the support surface to inhibit relative movement between the polishing pad and the support surface. In a particular embodiment of the invention, the interlocking element and the retaining member are configured so that the pad can move over the support surface along a travel path or axis, but relative movement between the pad and the support surface transverse to the travel axis is at least substantially inhibited.

The interlocking element and the retaining member can have several embodiments. For example, the interlocking element can be an elongated tongue on the second surface of the polishing pad extending along the travel axis and the retaining member can be an elongated groove in the support surface. The interlocking element and the retaining member can alternatively be another type of a protuberance and a reciprocal depression combination, such as elongated ridges or teeth extending along the travel axis. In the above embodiments, the support surface can further include one or more apertures coupled with a fluid pump to draw together or blow apart the interlocking elements and the retaining members.

DETAILED DESCRIPTION OF THE INVENTION

The present invention is directed toward the methods and apparatuses for releasably engaging a polishing pad with a support surface of a planarizing machine to restrict movement of the polishing pad in mechanical and/or chemical-mechanical planarization of microelectronic-device substrate assemblies. Several embodiments of the invention are directed toward polishing pads having interlocking elements that engage reciprocal retaining members on the support surface in a manner that restricts the pad from moving transversely to a travel axis but allows the pad to move along the travel axis. Many specific details of certain embodiments of the invention are set forth in the following description and in FIGS. 2A–6 to provide a thorough understanding of such embodiments. One skilled in the air, however, will understand that the present invention may have additional embodiments, or that the invention may be practiced without several of the details described in the following description.

Figure 1:
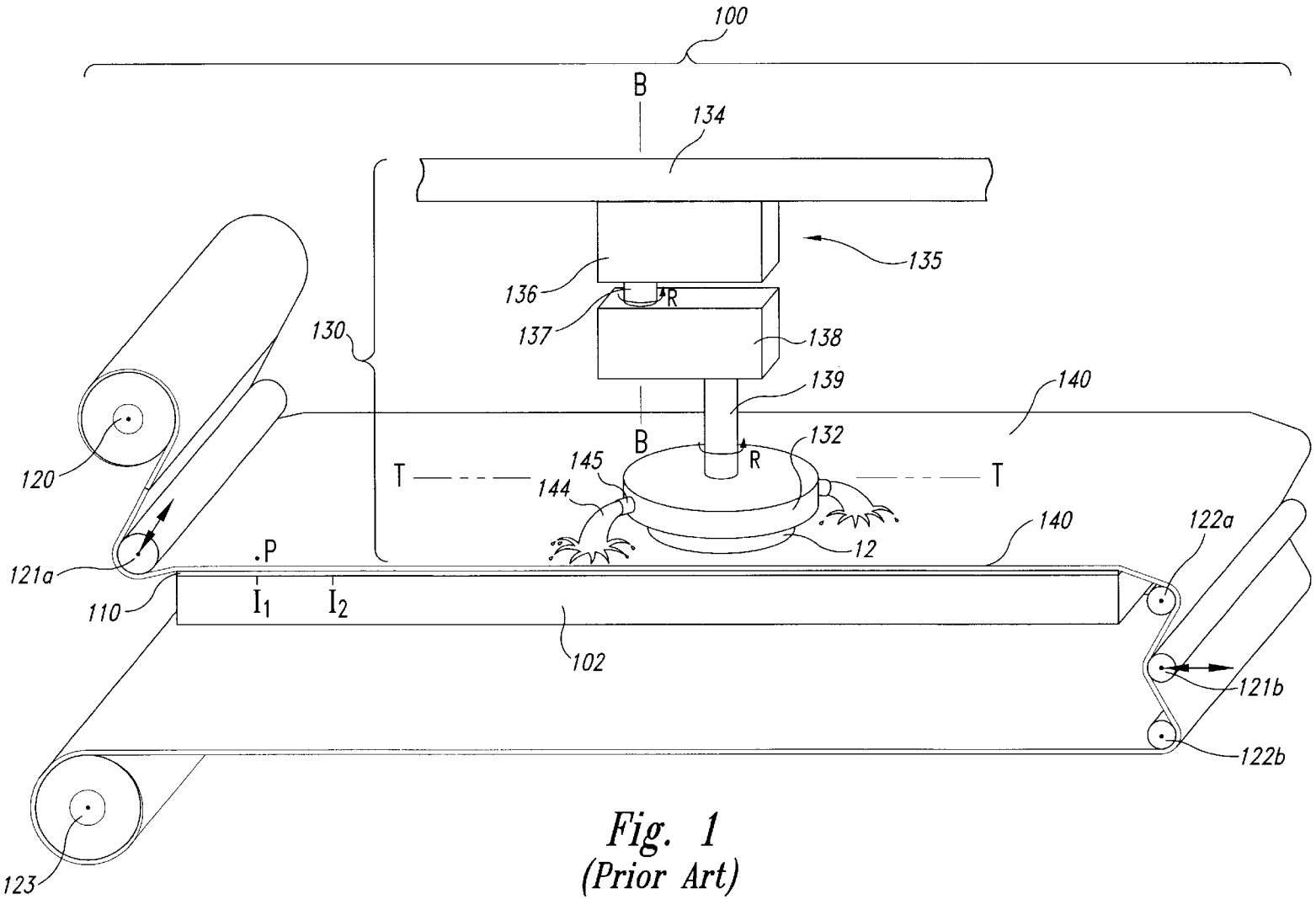
Fig. 1 (Prior Art)
FIG. 1 is a schematic isometric view of a web-format planarizing machine with a web-format polishing pad in accordance with the prior art.
Figure 2A:
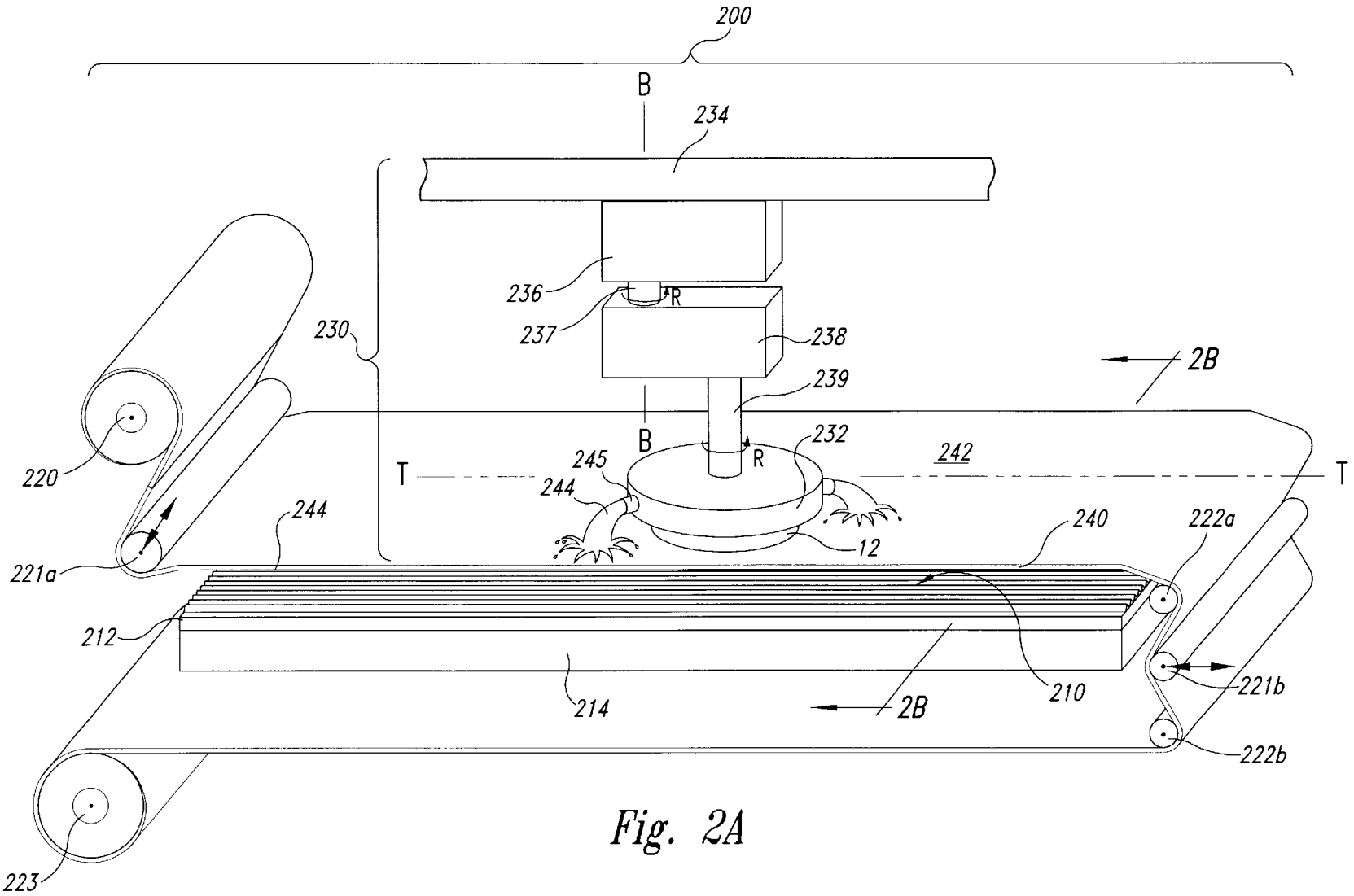
FIG. 2A is a schematic isometric exploded view of a web-format planarizing machine including a sub-pad and a polishing pad having elongated ridges in accordance with an embodiment of the invention.

FIG. 2A is a schematic isometric view partially illustrating a web-format CMP apparatus 200 having a support surface 210 defined by an upper surface of a sub-pad 212 and a web-format polishing pad 240 in accordance with one embodiment of the invention. The planarizing machine 200 may also have a carrier assembly 230 and a plurality of rollers for selectively moving the polishing pad 240 over the support surface 210 along a travel axis T—T. The carrier assembly 230 and the rollers 220, 221*a*, 221*b*, 222*a*, 222*b*, and 223 can be similar to those described above with reference to FIG. 1. The support surface 210 and the polishing pad 240 of this embodiment, however, interlock with one another to allow the pad 240 to slide along the travel axis T—T, but to at least substantially inhibit the polishing pad 240 from moving transversely to the travel axis T—T during a planarizing,j cycle. For the purposes of the present disclosure, "transverse" is defined as any non-parallel movement or configuration.

Figure 2B:
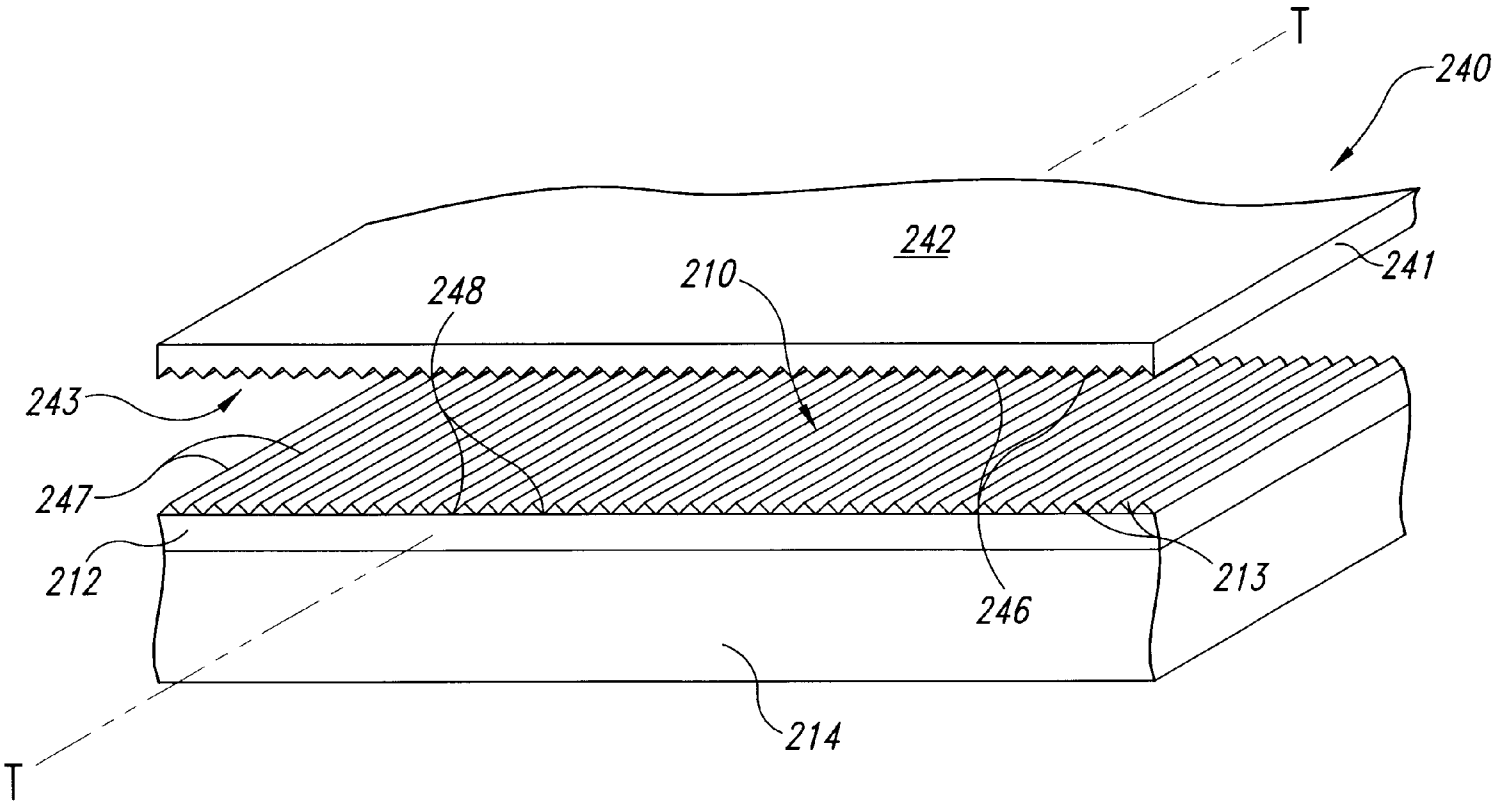
FIG. 2B is a partial cross-sectional isometric view of the polishing pad and the sub-pad of FIG. 2A along line 2B—2B.

FIG. 2B is a partial cross-sectional view illustrating the polishing pad 240 and the support surface 210 of the sub-pad 212 in greater detail. Referring to FIGS. 2A and 2B together, the polishing pad 240 of this embodiment has a body 241 with a planarizing surface 242 configured to engage the substrate assembly 12 and a backside surface 243 configured to engage the support surface 210. The planarizing surface 242 can be a highly planar surface, or it can have grooves, wells or other surface topographies to transport or hold a planarizing solution under the substrate assembly. The backside surface 243 of the pad 240 can have at least one, and preferably a plurality, of interlocking elements 246. In this embodiment, for example, the interlocking elements 246 are elongated ridges extending along the backside 243 in a direction at least substantially parallel to the pad travel axis T—T. The support surface 210 of sub-pad 212 can have at least one, and preferably a plurality, of retaining members 213 configured to releasably engage the interlocking elements 246. In this embodiment, the retaining members 213 are elongated ridges extending along the support surface 210 to interlock with the interlocking elements 246. The elongated ridges defining the interlocking elements 246 and the retaining members 213 preferably have a plurality of alternating peaks 247 and troughs 248 with substantially similar dimensions. In one embodiment, the peaks 247 have a height of approximately 10–1000 $\mu$m. The representation of the peaks 247 and troughs 248 in FIG. 2, therefore, is exaggerated for purposes of illustration.

The sub-pad 212 interlocks with the polishing pad 240 to control the motion of the polishing pad 240 relative to the travel axis T—T. The sub-pad 212 is preferably attached to a rigid, flat panel or plate 214, such as a table. The sub-pad 212, for example, can be attached to the panel 214 with an adhesive, tape or other suitable compound typically used to adhere circular polishing pads to rotary planarizing machines. The fixed sub-pad 212 at least substantially inhibits the polishing pad 240 from moving in a direction transverse to the travel axis T—T because the intermeshing of the elongated ridges 213 and the interlocking elements 246 impedes transverse movement between the sub-pad 212 and the pad 214. The interlocking elements 246 and the retaining members 213, however, allow the polishing pad 240 to move freely over the support surface 210 along the travel axis T—T.

FIG. 2A best illustrates an embodiment of planarizing the substrate assembly 12 with the planarizing apparatus 200. During planarization of the substrate assembly 12, the actuator 236 orbits the substrate assembly holder 232 about the axis B—B to move the substrate assembly 12 across the pad 240. The first idler roller 221*a* and the first guide roller 222*a* stretch the polishing pad 240 over the sub-pad 212 to intermesh the interlocking elements 246 and the retaining members 213. Thus, as the actuator 236 orbits the substrate assembly 12 across the polishing pad 240, the interlocking elements 246 and the retaining members 213 impede the pad 240 from moving transversely to the travel axis T—T. After the substrate assembly 12 is planarized and removed from the pad 240, the supply and take up rollers 220 and 223 slide the polishing pad 240 over the sub-pad 212 along the travel axis T—T. The interlocking elements 246 and retaining members 213 accordingly allow the pad 240 to move axially along the travel axis T—T because they extend at least substantially parallel to the travel axis T—T.

This embodiment of the planarizing apparatus 200 is expected to prolong the pad life and provide consistent planarizing results. Unlike existing vacuum designs or adhesives, the planarizing apparatus 200 engages the interlocking elements 246 of the polishing pad 240 with the retaining members 213 of the sub-pad 212 to allow relative movement in a first direction (e.g., along the travel axis T—T) but to inhibit relative movement transverse to the first direction. One expected result of inhibiting such transverse movement of the polishing pad 240 is to reduce wear or damage to the polishing pad 240 caused by stretching and/or twisting the pad transversely to the travel axis T—T. Additionally, by reducing such wear of the polishing pad 240, the planarizing surface 242 is expected to wear more evenly to produce more consistent planarizing results. Another expected result of inhibiting such transverse movement of the polishing pad 240 is to reduce the volume of planarizing solution that seeps underneath the polishing pad 240, which is expected to further reduce uneven wear of the pad and contamination of the planarizing machine 200. Thus, the planarizing apparatus 200 is expected to prolong the pad life and to more consistently planarize substrate assemblies.

In another embodiment of the planarizing apparatus 200, the polishing pad 240 can be directly supported by the table 214 without the sub-pad 212. The top surface of the table 214, therefore, can have at least one, and preferably a plurality, of retaining members configured to releasably engage the interlocking elements of the polishing pad 240. In one embodiment, the retaining members are elongated ridges extending along the table 214 similar to the retaining members 213 on the sub-pad. The polishing pad 240 can thus engage the top surface of the table 214 directly such that the support surface is defined by the top surface of the table 214.

Figure 3A:
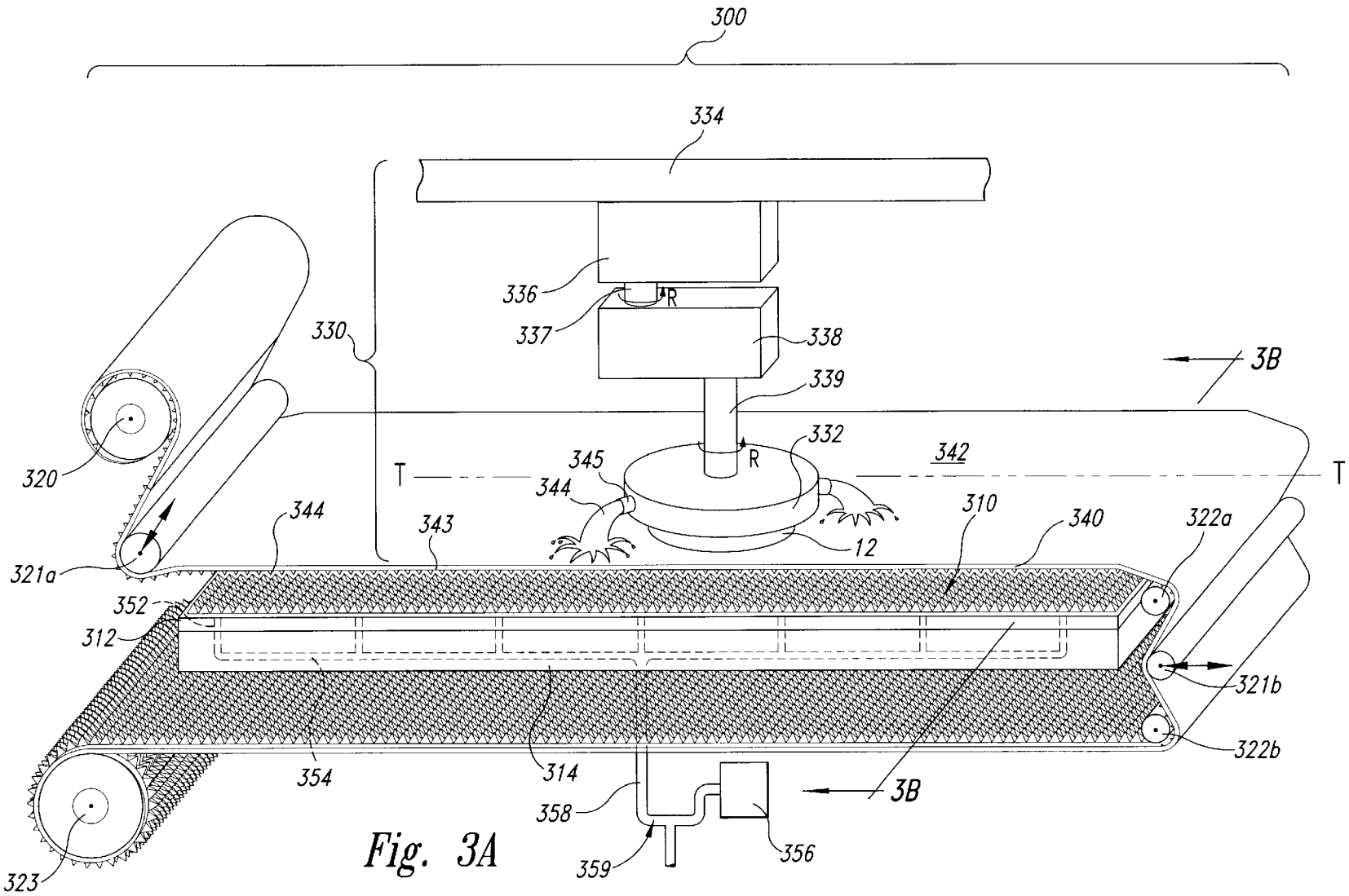
FIG. 3A is a schematic isometric exploded view of a web-format planarizing machine including a sub-pad having a plurality of teeth and a polishing pad having a plurality of reciprocal teeth in accordance with another embodiment of the invention.
Figure 3B:
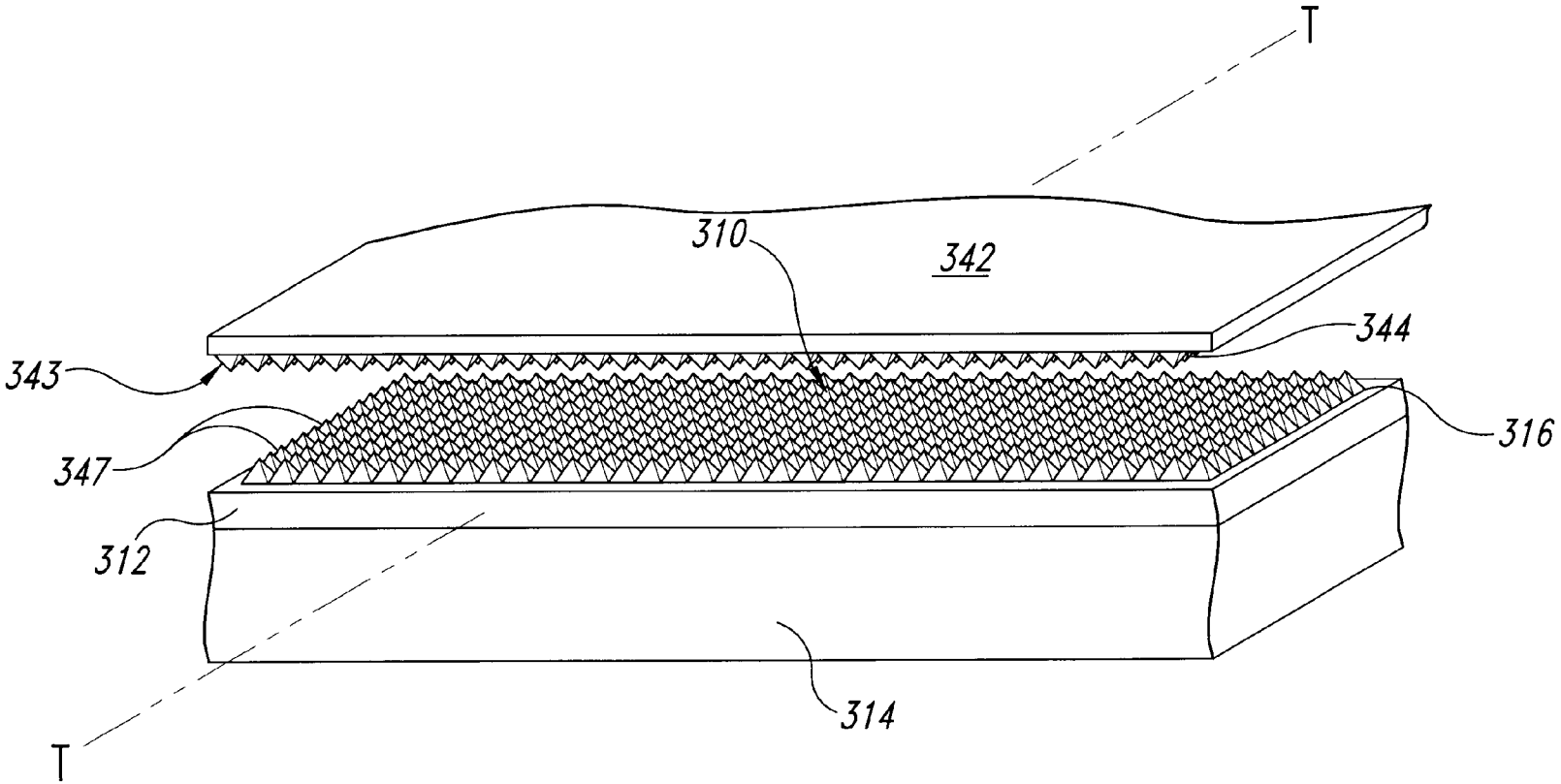
FIG. 3B is a partial cross-sectional isometric view of the polishing pad and the sub-pad of FIG. 3A taken along line 3B—3B.

FIG. 3A is a schematic isometric view partially illustrating a web-format CMP apparatus 300 having a support surface 310 defined by an upper surface of a sub-pad 312 and a web-format polishing pad 340 in accordance with another embodiment of the invention. The planarizing machine 300 may also have a carrier assembly 330 and a plurality of rollers for selectively moving the polishing pad 340 over the support surface 310 along a travel axis T—T. In this embodiment, the support surface 310 and the polishing pad 340 can interlock with one another to substantially inhibit the polishing pad 340 from moving in any direction during a planarizing cycle FIG. 3B is a partial cross-sectional view illustrating the polishing pad 340 and the support surface 310 of the sub-pad 312 in greater detail. Referring to FIGS. 3A and 3B together, several aspects of the polishing pad 340 of this embodiment can be similar to the polishing pad described above with reference to FIGS. 2A and 2B. In this embodiment, polishing pad 340 has a planarizing surface 342 configured to planarize a microelectronic-device substrate, a backside 343 opposite the planarizing surface 342, and a plurality of pyramidal interlocking elements 344 projecting from the backside 343. The support surface 310 of the sub-pad 312 can have at least one, and preferably a plurality, of pyramidal retaining members 316 configured to releasably engage the interlocking elements 344. The pyramidal interlocking elements 344 and retaining members 316 preferably have a plurality of alternating peaks 347 and depressions 348 with substantially similar dimensions such that the depressions of one receives the peaks of the other. In one embodiment, the pyramidal interlocking elements 344 and retaining members 316 have a height from approximately 10–1000 $\mu$m, and more particularly from 30–50 $\mu$m. The representation of the interlocking elements 344 and the retaining members 316 in FIGS. 3A and 3B is thus exaggerated for purposes of illustration.

The sub-pad 312 interlocks with the polishing pad 340 to control the motion of the polishing pad 340 relative to the sub-pad 312. The sub-pad 312 is preferably attached to a rigid, flat panel or plate 314, such as a table in a manner similar to that described above with reference to FIGS. 2A and 2B. The table 314 and the sub-pad 312 may further include a plurality of fluid apertures 352 in fluid communication with a fluid passageway 354. The fluid apertures 352 may have a circular cross-sectional shape, comprise slots or have other shapes in other embodiments. The fluid passageway 354 is connected to a conduit 358 that is in turn coupled to a pump 356 that can draw a fluid or blow a fluid through the passageway 354. A liquid trap may be positioned in the conduit 358 and apart from the base to separate liquid from the fluid drawn by the pump 356. In another embodiment, the liquid trap 359 may form an integral component of the pump 356.

In operation, the polishing, pad 340 is rolled up on the supply roller 320 and one end is extended over the table 314 and attached to the take-up roller 323. The pump 356 draws a fluid against the backside 343 of the pad 340 to draw the polishing pad 340 tightly against the sub-pad 312. The carrier assembly 330 moves relative to the polishing pad 340 and presses the substrate 12 against the planarizing surface 342 to planarize the semiconductor substrate assembly 12. Periodically, either during the planarization of a single substrate assembly 12 or after a substrate has been planarized, the carrier assembly 330 disengages the substrate assembly 12 from the pad 340 and the pump 356 reverses the flow to blow fluid through the passageway 354. The positive pressure in the passageway 354 disengages the interlocking elements 344 from the retaining member 316 so that the rollers 320 and 323 can advance the polishing pad 340 over the sub-pad 312. Once the polishing pad 340 has been advanced, the pump 356 may draw the fluid against the pad 340 to reengage the interlocking elements 344 and the retaining members 316.

In an alternative embodiment (not shown) the pump 356 can be replaced with a source of electrical current to apply a charge to the table 314 and attract the polishing pad 340 toward the table 314 via electrostatic forces. In one aspect of this alternative embodiment, the polishing pad 340 can include a conductive layer adjacent the table 314, and in another aspect of this alternative embodiment the polishing pad 340 can include particles capable of receiving an induced electrostatic force. In addition to web-for-mat machines, the polishing pad 340 and sub-pad 312 can be cut in circular sheets for use on rotary planarizing machines, such as those disclosed in U.S. Pat. Nos. 5,486,131; 5,456,627; and 5,020,283, all of which are herein incorporated by reference.

The CMP apparatus 300 shown in FIG. 3A can securely engage the polishing pad 340 with the sub-pad 312 to prevent the pad 340 from wrinkling or folding when the semiconductor substrate assembly 12 is planarized. The CMP apparatus 300 shown in FIG. 3A also releasably attaches the polishing pad 340 to the sub-pad 312 without the need for tensioning the polishing pad 340. Accordingly, the polishing pad 340 may be less likely to stretch or otherwise deform.

Figure 4A:
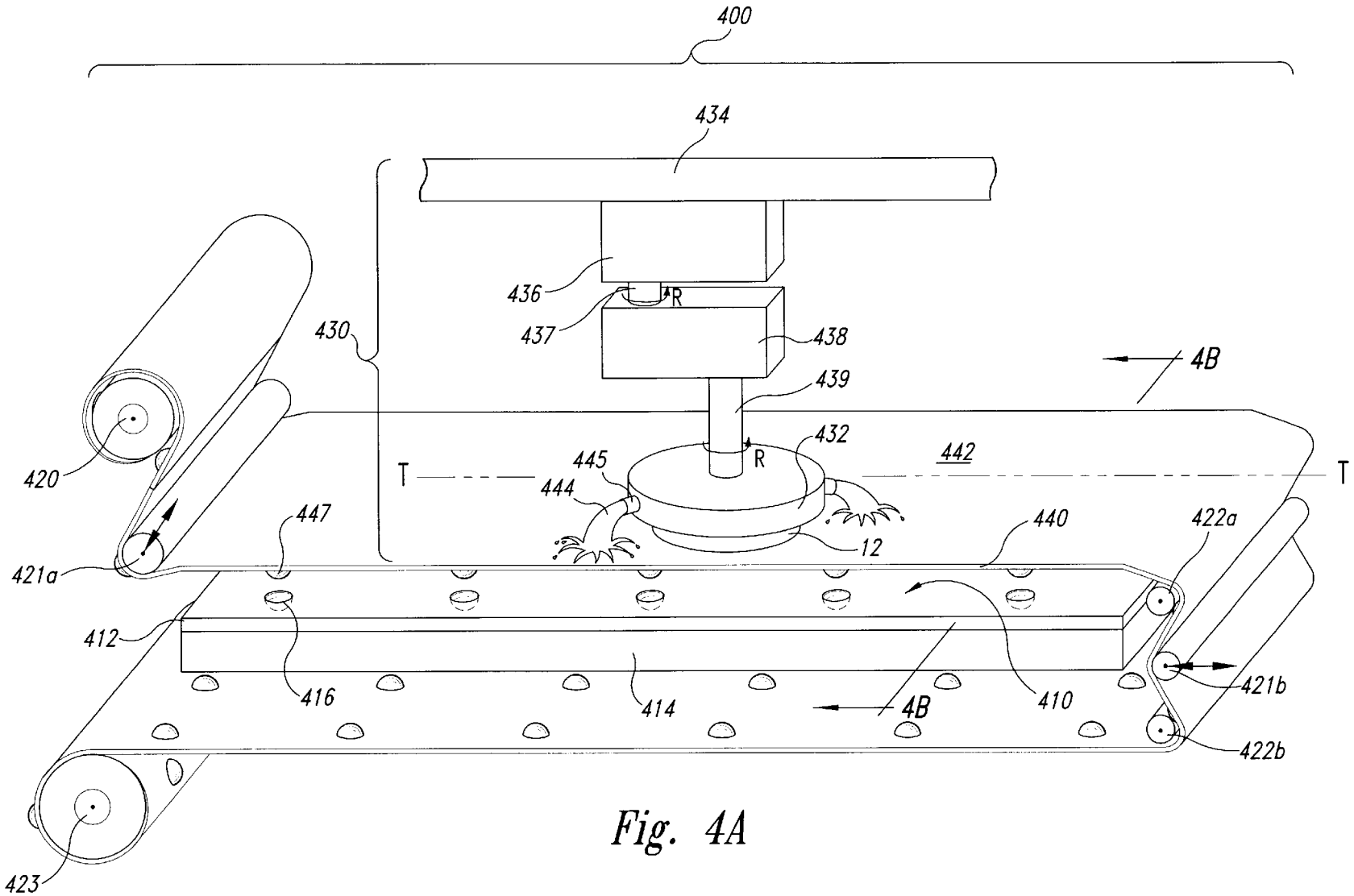
FIG. 4A is a schematic isometric exploded view of a web-format planarizing machine including a sub-pad having depressions and a polishing pad having reciprocal protuberances in accordance with still another embodiment of the invention.

FIG. 4A is a schematic isometric view illustrating a web-format CMP apparatus 400 having a support surface 410 defined by an upper surface of a sub-pad 412 and a web-format polishing pad 440 in accordance with still another embodiment of the invention. The carrier assembly 430 and rollers can be similar to those described above with reference to FIG. 1. The support surface 410 may also have a plurality of apertures (not shown) similar to those shown in FIG. 3A to draw a fluid to create a vacuum or blow the fluid to apply a positive pressure against the pad 440.

Figure 4B:
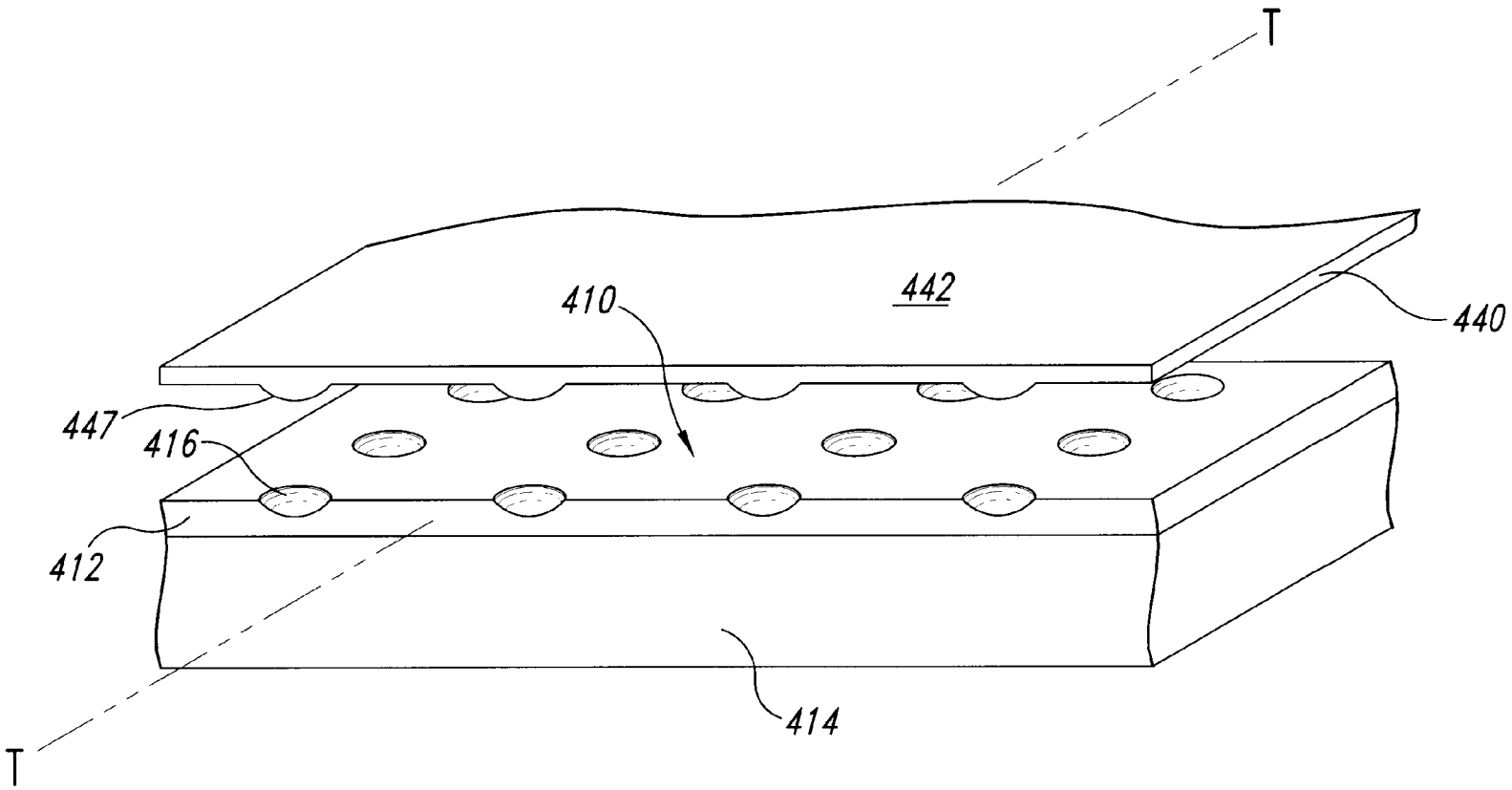
FIGS. 4B and 4C are partial cross-sectional isometric views of alternative embodiments of the polishing pad and the sub-pad with depressions and reciprocal protuberances.
Figure 4C:
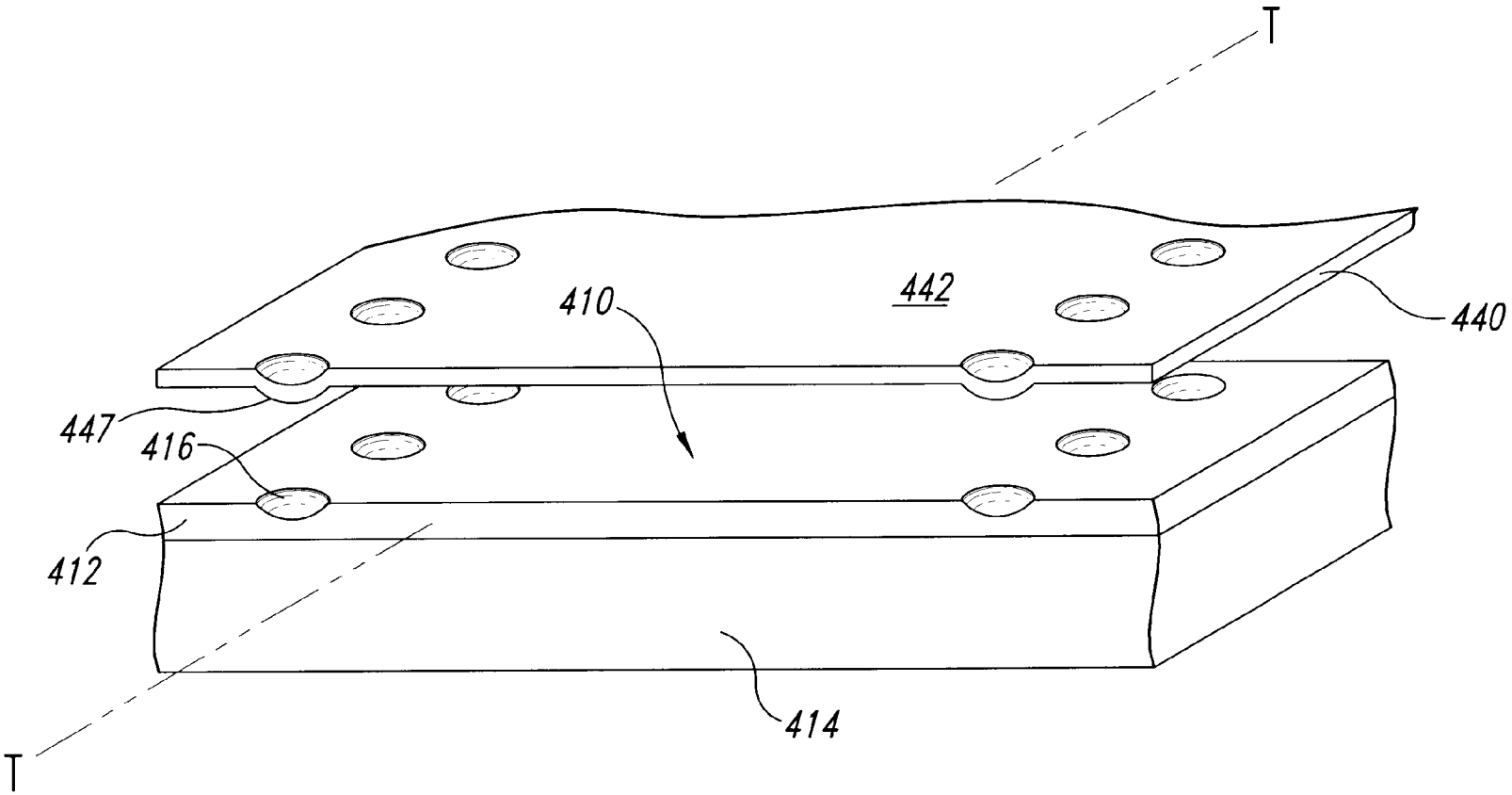

FIGS. 4B and 4C are partial cross-sectional views illustrating different aspects of the polishing pad 440 and the support surface 410 of the sub-pad 412 in greater detail. The support surface 410 has a plurality of retaining members 416 defined by hemispherical depressions in the support surface 410. The pad 440 in FIG. 4B has a flat planarizing surface 442 and a plurality of hemispherical interlocking elements 447 projecting from its backside. The planarizing surface 442 of the polishing pad 440 in FIG. 4C also has a plurality of depressions to receive the interlocking elements 447 when the pad 440 is rolled on the supply and take up rollers 420 and 423. In operation, the interlocking elements 447 mate with the retaining members 416 to inhibit relative movement between the pad 440 and the sub-pad 412.

Figure 5A:
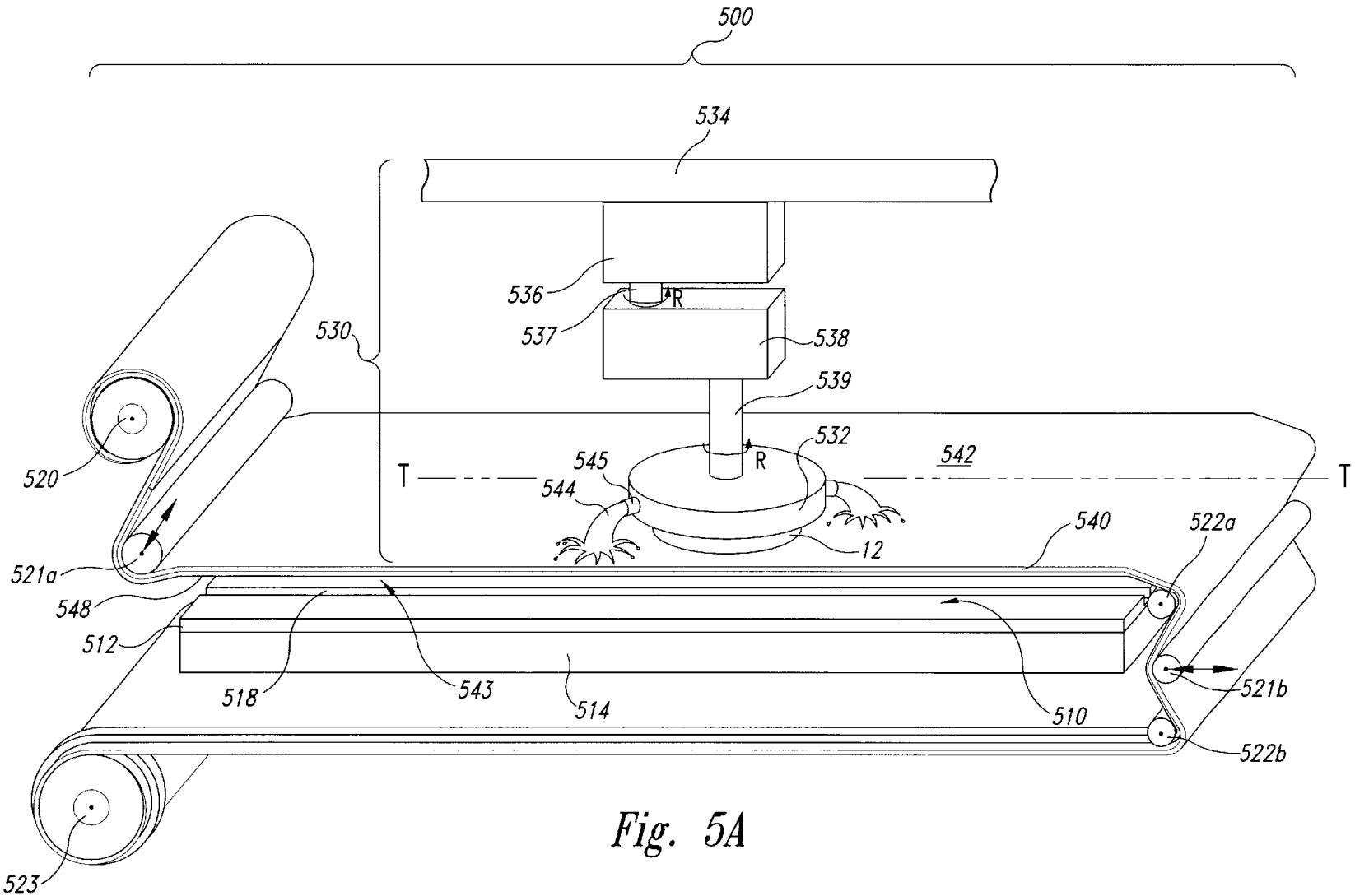
FIG. 5A is a schematic isometric exploded view of a web-format planarizing machine including a sub-pad having a groove and a polishing pad having a reciprocal tongue in accordance with yet another embodiment of the invention.

FIG. 5A is a schematic isometric view illustrating a web-format CMP apparatus 500 having a support surface 510 defined by an upper surface of a sub-pad 512 and a web-format polishing pad 540 in accordance with yet another embodiment of the invention. The carrier assembly 530 and rollers can be similar to those described above with reference to FIG. 1.

Figure 5B:
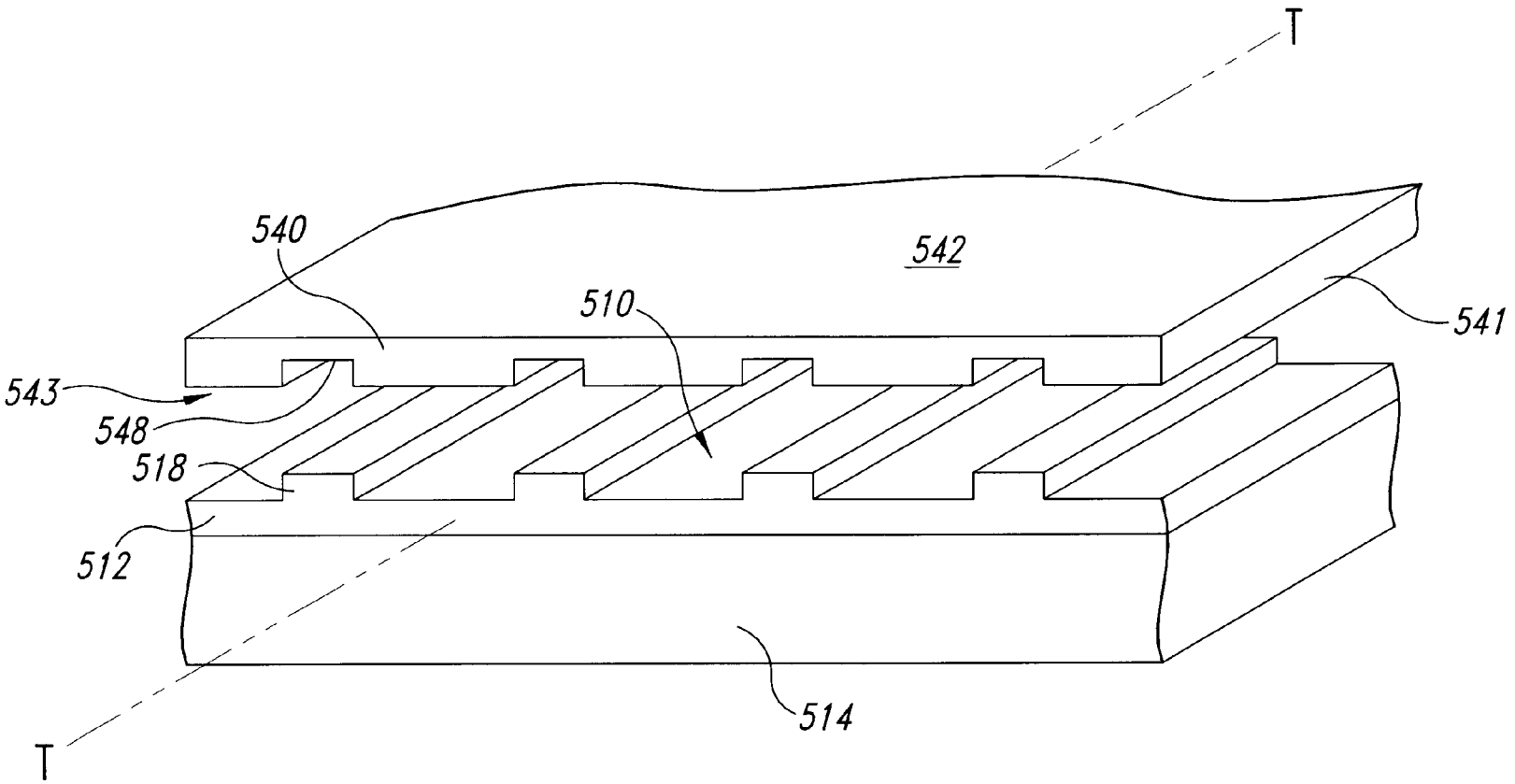
FIGS. 5B and 5C are partial cross-sectional isometric views of alternative embodiments of the polishing pad and the sub-pad with grooves and reciprocal tongues.
Figure 5C:
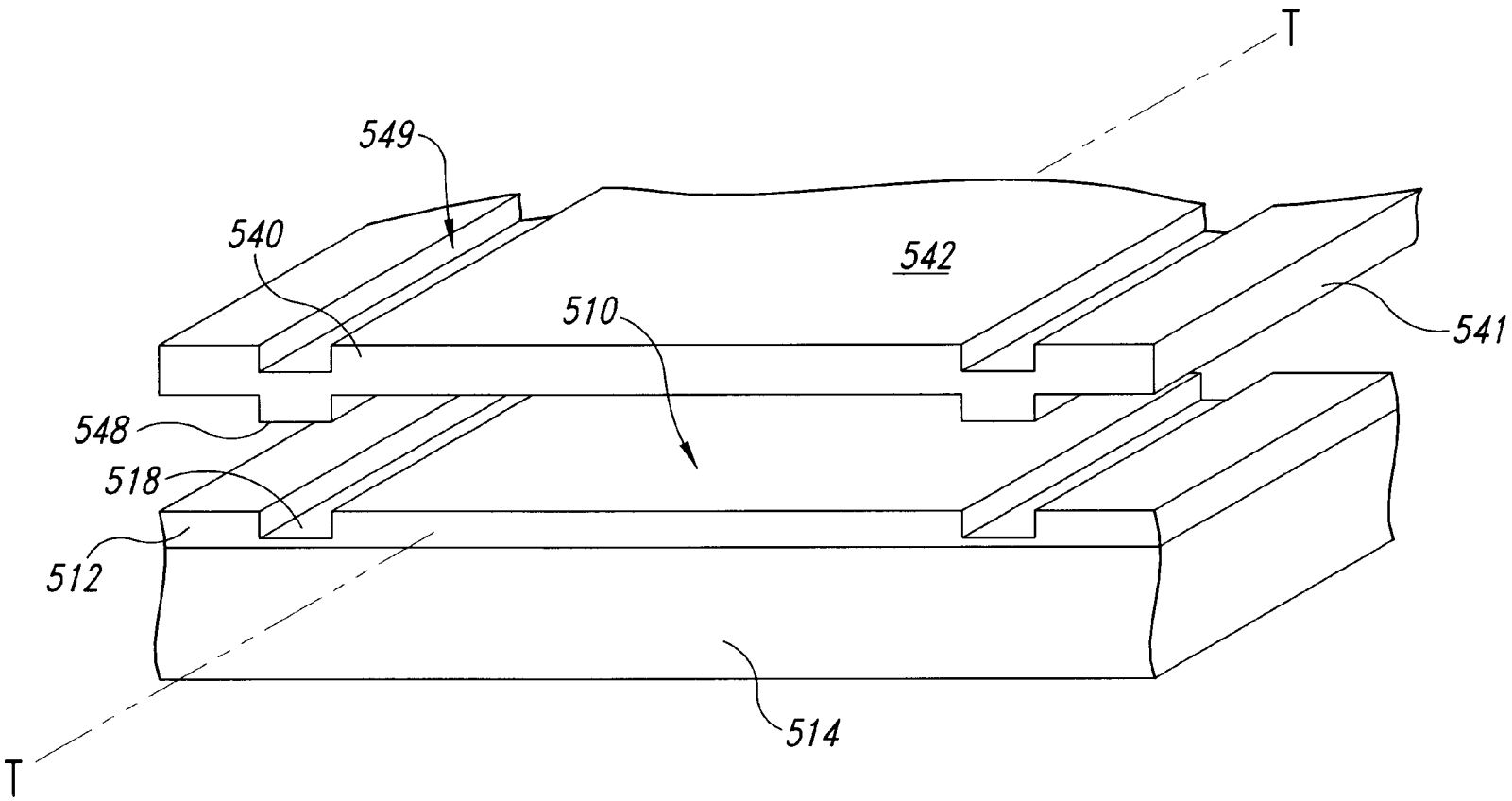

FIGS. 5B and 5C are partial cross-sectional views illustrating different aspects of the polishing pad 540 and the sub-pad 512 in greater detail. The support surface 5 10 of FIG. 5B has a plurality of retaining members 518 defined by elongated tongues extending in the direction of the travel path T—T. The polishing pad 540 of FIG. 5B has a flat planarizing surface 542 and a backside 543 with a plurality of interlocking elements 548 defined by elongated grooves. The sub-pad 512 and polishing pad 540 of FIG. 5C have an inverse tongue and groove arrangement from FIG. 5B. In this embodiment, the polishing pad 540 has at least one interlocking element 548 that is an elongated tongue configured to fit in a groove type retaining member 518. The planarizing surface 542 of the pad 540 shown in FIG. 5C also has at least one groove indentation 549 to receive a corresponding interlocking element 548 when the pad is rolled-up on the rollers 520 and 523.

The sub-pad 512 interlocks with the polishing pad 540 to control the motion of the polishing pad 540 relative to the sub-pad 512. The sub-pad 512 is preferably attached to a rigid, flat panel or plate 514, such as a table in a manner similar to that described with reference to FIGS. 2A and 2B. Alternatively, in applications without a sub-pad, the table 514 has at least one retaining member 518, such as an elongated groove or tongue, that interlocks with the interlocking element 548 to inhibit relative movement between the pad 540 and the table 514 transverse to the travel path T—T.

Figure 6:
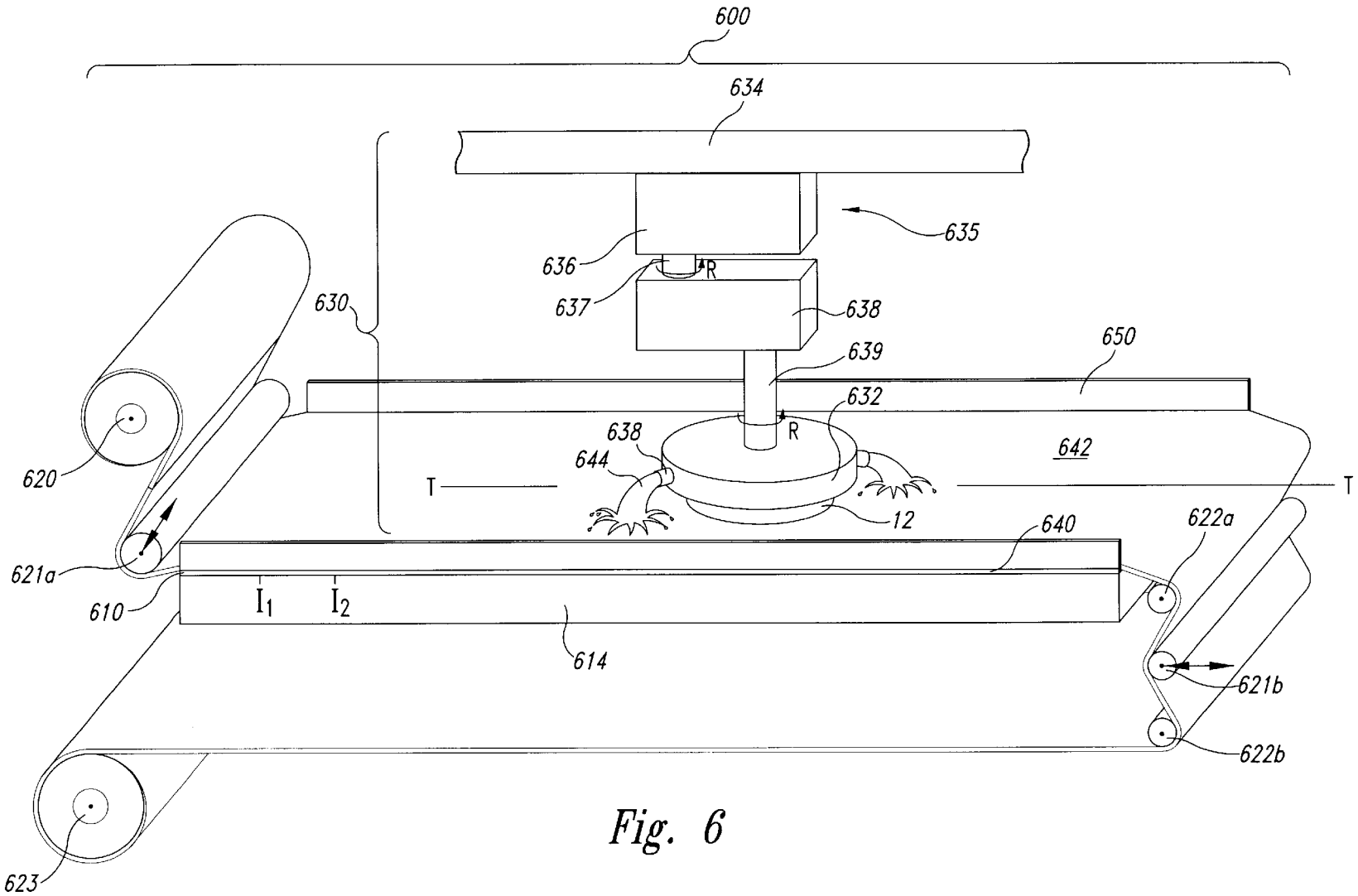
FIG. 6 is a schematic isometric view of a web-format planarizing machine with a support surface having guide rials in accordance with still another embodiment of the invention.

FIG. 6 is a schematic isometric view of a web-format CMP apparatus 600 having a support surface 610, a sub-pad 612, and a web-format polishing pad 640 similar to those described above with reference to FIG. 1. During planarization, the supply rollers 620 and the take up rollers 623 may provide a positive tension on the polishing pad 640 in the direction of travel T—T. In this embodiment, a guide wall 650 projects upwardly from each edge of the support surface 610 and extends substantially parallel to the direction of travel T—T. The guide walls 650 generally have a height above the thickness of the polishing pad 640 and are generally spaced apart the width of the polishing pad 640. The guide walls 650 permit the web-format polishing pad 640 to move freely in the direction of travel T—T, but inhibit the polishing pad 640 from moving transversely to the direction of travel path T—T.

In yet another alternate embodiment, the fluid pump components of FIG. 3A can be combined with any one of the above embodiments to engage the interlocking surfaces prior to planarization or to disengage the interlocking surfaces upon completion of the planarization cycle. In still another embodiment, the guide walls 650 of FIG. 6 can be combined with any one of the above embodiments to further restrict transverse movement of the polishing pad relative to the travel path T—T.

From the foregoing, it will be appreciated that, although specific embodiments of the invention have been described herein for purposes of illustration, various modifications may be made without deviating from the spirit and scope of the invention. For example, many embodiments of the invention can be used with rotary planarizing machines that have circular polishing pads and rotating platens. Accordingly, the invention is not limited except as by the appended claims.

What is claimed is:

1. A polishing pad for planarization of a microelectronic-device substrate assembly, comprising a body having a planarizing surface configured to engage the substrate assembly, a backside surface configured to engage a support surface on a planarizing machine, and an interlocking element on the backside surface, the interlocking element being configured to engage a corresponding retaining member on the support surface and where the interlocking element on the backside surface of the polishing pad comprises at least one groove extending in a direction parallel to a travel path of the pad, and the retaining member comprises at least one tongue extending in the direction of the travel path, the groove being configured to mate with the tongue to allow relative movement between the polishing pad and the support surface in a direction along the travel path and at least substantially inhibit relative movement between the polishing pad and the support surface transverse to the travel path.

2. A polishing pad for planarization of a microelectronic-device substrate assembly, comprising a body having a planarizing surface configured to engage the substrate assembly, a backside surface configured to engage a support surface on a planarizing machine, and an interlocking element on the backside surface, the interlocking element being configured to engage a corresponding retaining member on the support surface and where the backside comprises a plurality of teeth and the retaining member on the support surface comprises a plurality of complimentary teeth configured to intermesh with the teeth on the backside surface of the polishing pad.

3. A polishing pad for planarization of a microelectronic-device substrate assembly, comprising a body having a planarizing surface configured to engage the substrate assembly, a backside surface configured to engage a support surface on a planarizing machine, and an interlocking element on the backside surface, the interlocking element being configured to engage a corresponding retaining member on the support surface, the interlocking element also being configured to allow relative movement between the polishing pad and the support surface in a first direction and at least substantially inhibit relative movement between the polishing pad and the support surface transverse to the first direction.

4. A polishing pad for planarization of a microelectronic-device substrate assembly, comprising a body having a planarizing surface configured to engage the substrate assembly, a backside surface configured to engage a support surface on a planarizing machine, and an interlocking element on the backside surface, the interlocking element being configured to engage a corresponding retaining member on the support surface and where the interlocking element comprises an elongated tongue extending in a first direction, and the retaining member comprises an elongated groove extending in the first direction, the groove being configured to receive the tongue.

5. A polishing pad for planarization of a microelectronic-device substrate assembly, comprising a body having a planarizing surface configured to engage the substrate assembly, a backside surface configured to engage a support surface on a planarizing machine, and an interlocking element on the backside surface, the interlocking element being configured to engage a corresponding retaining member on the support surface and where the interlocking element comprises an elongated groove extending in a first direction, and the retaining member comprises an elongated tongue extending in the first direction, the tongue being configured to mate with the groove.

6. A polishing pad for planarization of a microelectronic-device substrate assembly, comprising a body having a planarizing surface configured to engage the substrate assembly, a backside surface configured to engage a support surface on a planarizing machine, and an interlocking element on the backside surface, the interlocking element being configured to engage a corresponding retaining member on the support surface and where the interlocking element comprises a protuberance projecting away from the backside surface, and the retaining member comprises a depression extending into the support surface, the depression in the support surface being configured to receive the protuberance on the backside surface.

7. Wherein a polishing pad for planarization of a microelectronic-device substrate assembly, comprising a body having a planarizing surface configured to engage the substrate assembly, a backside surface configured to engage a support surface on a planarizing machine, and an interlocking element on the backside surface, the interlocking element being configured to engage a corresponding retaining member on the support surface and where the interlocking element comprises a depression extending into the backside surface, and the retaining member comprises a protuberance projecting away from the support surface, the protuberance on the support surface being configured to mate with the depression in the backside surface.

8. A polishing pad for planarization of a microelectronic-device substrate assembly, comprising a body having a planarizing surface configured to engage the substrate assembly, a backside surface configured to engage a support surface on a planarizing machine, and an interlocking element on the backside surface, the interlocking element being configured to engage a corresponding retaining member on the support surface and where the interlocking element comprises a first plurality of pyramidal teeth and the retaining member comprises a second plurality of pyramidal teeth configured to intermesh with the first plurality of teeth.

9. A polishing pad for planarization of a microelectronic-device substrate assembly, comprising a body having a planarizing surface configured to engage the substrate assembly, a backside surface configured to engage a support surface on a planarizing machine, and an interlocking element on the backside surface, the interlocking element being configured to engage a corresponding retaining member on the support surface and where the interlocking element comprises a first plurality of elongated ridges extending in a first direction, and the retaining member comprises a second plurality of elongated ridges extending in the first direction, the first and second plurality of elongated ridges being configured to intermesh with one another.

10. A polishing pad for planarization of a microelectronic-device substrate assembly, comprising a body having a planarizing surface configured to engage the substrate assembly, a backside surface configured to engage a support surface on a planarizing machine, and an interlocking element on the backside surface, the interlocking element being configured to engage a corresponding retaining member on the support surface and where the interlocking element comprises a pyramidal protuberance having a peak projecting away from the backside surface and a base at the backside surface, and the retaining member comprises a pyramidal protuberance having a peak projecting away from the support surface and a base at the support surface, wherein the peak of the pyramidal retaining member engages the base of the pyramidal interlocking element.

11. The polishing pad of claim 10 wherein the pyramidal interlocking element and the retaining member have heights of approximately 10–1000 $\mu$m.

12. The polishing pad of claim 10 wherein the pyramidal interlocking element and the retaining member have heights of approximately 30–50 $\mu$m.

* * * * *